US006499838B2

(12) United States Patent
Seccombe et al.

(10) Patent No.: US 6,499,838 B2
(45) **Date of Patent: *Dec. 31, 2002**

(54) METHOD AND APPARATUS FOR PRESSURIZING INK IN A PRINTER INK SUPPLY USING SPRING FORCE

(75) Inventors: S. Dana Seccombe, Foster City, CA (US); Charles R. Steinmetz, Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/877,925

(22) Filed: Jun. 7, 2001

(65) Prior Publication Data

US 2001/0043256 A1 Nov. 22, 2001

Related U.S. Application Data

(63) Continuation of application No. 09/240,092, filed on Jan. 29, 1999, now Pat. No. 6,331,053.

(51) Int. Cl.[7] ..... B41J 2/175
(52) U.S. Cl. ..... 347/85
(58) Field of Search ..... 347/85, 86, 87, 347/7; 222/99, 100

(56) References Cited

U.S. PATENT DOCUMENTS

| | | | | | |
|---|---|---|---|---|---|
| 4,471,500 | A | | 9/1984 | Long et al. | 4/499 |
| 4,579,826 | A | | 4/1986 | Bolton et al. | 436/132 |
| 4,604,633 | A | | 8/1986 | Kimura et al. | 347/7 |
| 4,765,512 | A | * | 8/1988 | Bull | 222/100 |
| 5,110,316 | A | | 5/1992 | Shaw et al. | 446/202 |
| 5,453,772 | A | * | 9/1995 | Aono et al. | 347/87 |
| 5,650,811 | A | * | 7/1997 | Seccombe et al. | 347/85 |
| 5,719,610 | A | | 2/1998 | Scheffelin | 347/86 |
| 5,745,137 | A | | 4/1998 | Scheffelin et al. | 347/85 |
| 5,988,802 | A | * | 11/1999 | Pawlowski et al. | 347/86 |
| 6,331,053 | B1 | * | 12/2001 | Seccombe et al. | 347/85 |

FOREIGN PATENT DOCUMENTS

| | | |
|---|---|---|
| EP | 739 740 | * 10/1996 |
| JP | 6-183020 | * 7/1994 |

* cited by examiner

*Primary Examiner*—Michael Nghiem
(74) *Attorney, Agent, or Firm*—Kevin B. Sullivan; Teri G. Andrews

(57) ABSTRACT

The present invention is a constant pressure ink supply for use in a printing system. The ink supply includes a flexible fluid reservoir for containing a quantity of fluid, and a spring which has an expanded position, and a contracted position. The spring is configured to operatively engage the flexible ink reservoir as the spring transitions from the expanded position to the contracted position and wherein the flexible fluid reservoir is biased by the spring as the spring contracts to produce fluid at a substantially constant fluid pressure at a fluid outlet.

16 Claims, 10 Drawing Sheets

METHOD AND APPARATUS FOR PRESSURIZING INK IN A PRINTER INK SUPPLY USING SPRING FORCE

CROSS REFERENCE TO RELATED APPLICATION(S)

This is a continuation of copending application Ser. No. 09/240,092, filed on Jan. 29, 1999, now U.S. Pat. No. 6,331,053.

FIELD OF THE INVENTION

The present invention relates to an ink reservoir for providing a supply of pressurized ink to a printer. More particularly, the present invention relates to a method and apparatus for biasing a flexible ink reservoir to provide a supply of ink at constant pressure to the printer.

BACKGROUND AND SUMMARY OF THE INVENTION

Printers typically include a drop ejection device and a supply of ink for replenishing the drop ejection device. In the case of thermal printing, the drop ejection device is typically referred to as a printhead. Printing is accomplished by the selective activation of the printhead as the printhead is moved relative to a print media.

One previously used type of printer makes use of an ink reservoir that is separately replaceable from the printhead. As ink is selectively deposited on print media, the ink reservoir replenishes the printhead with ink. In this embodiment, a region within the printhead is maintained at a slight vacuum, sometimes referred to as "backpressure." Typically, this backpressure is approximately two to three inches of water below atmospheric pressure. This backpressure within the printhead tends to prevent ink from leaking or drooling from nozzles within the printhead which can reduce print quality. If this backpressure is too large, ink flow to ink ejection chambers is reduced. This is sometimes referred to as "printhead starvation" resulting in print quality degradation and possible printhead failure.

The replaceable ink reservoir can be positioned on a scanning carriage with the printhead or positioned off the scanning carriage. In the case where the ink reservoir is mounted off carriage, the ink reservoir can be continuously in fluid communication with the printhead such as connected by a flexible conduit or intermittently connected by positioning the carriage proximate a refilling station that is in fluid communication with the printhead. The printhead is selectively replenished with ink from the refilling station. Using a replaceable ink reservoir allows for the replacement of the ink reservoir separate from the printhead allowing the use of the printhead until end of printhead life thereby reducing the cost per page of printing to the consumer.

It is frequently useful for providing a pressurized supply of ink to the printhead to achieve high flow rates or greater reliability. High flow rates are sometimes required in large format printing. Large format printing often involves printing on print media on the order of 34–54 inches in width. High flow rates are required in small format printing in cases where high print speed is required.

Various schemes have been suggested for pressurizing sources of ink. U.S. Pat. No. 5,650,811 entitled "Apparatus for Providing Ink to a Printhead", issued Jul. 22, 1997, to Seccombe et al., discloses the use of a spring for urging a piston to engage a deformable bag filled with ink.

There is an ever-present need for techniques for providing a pressurized supply of ink to achieve high flow rates and high reliability. These techniques should minimize pressure variations thereby reducing the pressure range in which the pressure regulator must compensate. In addition, these techniques should be volumetrically efficient to provide a compact ink reservoir, well suited to high volume manufacturing and be relatively low cost thereby reducing the per page print costs.

These techniques should be capable of dispensing substantially all of the ink from the replaceable ink reservoir. Stranding ink in the replaceable ink reservoir tends to reduce the consumer value. In addition, stranded ink within the replaceable ink container produces an added component in the waste stream when the ink container is discarded.

Finally, these techniques for producing a pressurized supply of ink should allow for the determination of remaining ink in the ink reservoir. It is important that the remaining ink in the ink reservoir be capable of accurately being measured to provide advance notice that the ink reservoir is in need of replacement. Another important reason for determining an amount of remaining ink in the ink reservoir is to prevent operation of the printer when the ink reservoir is exhausted of ink. In the case of thermal printers, operation of the printhead without an adequate supply of ink can result in catastrophic damage to the printhead.

SUMMARY OF THE INVENTION

The present invention is a constant pressure ink supply for use in a printing system. The ink supply includes a flexible fluid reservoir for containing a quantity of fluid, and a spring which has an expanded position, and a contracted position. The spring is configured to operatively engage the flexible ink reservoir as the spring transitions from the expanded position to the contracted position and wherein the flexible fluid reservoir is biased by the spring as the spring contracts to produce fluid at a substantially constant fluid pressure at a fluid outlet.

DETAILED DESCRIPTION OF A PREFERRED EMBODIMENT

Figure 1:
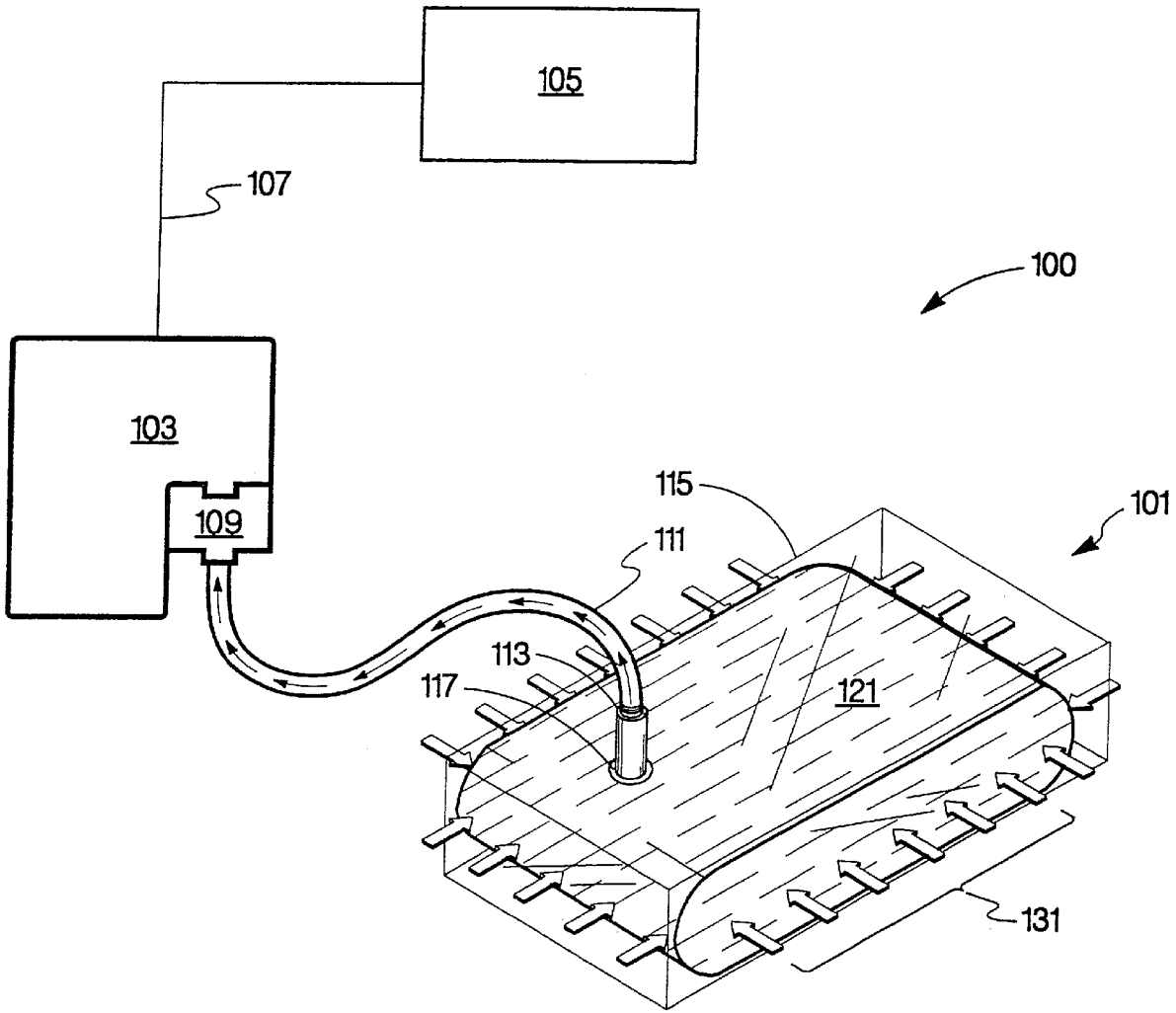
FIG. 1 depicts a schematic representation of a printing system that includes a constant pressure ink supply of the present invention.

FIG. 1 depicts a schematic representation of a printing system 100 that includes a constant pressure ink supply 101 of the present invention. Ink supply 101 has a flexible ink reservoir 121 that contains a quantity of ink for printing. Flexible ink reservoir 121 includes a fluid outlet 113 that is fluidly connected to a printhead 103 by a fluid conduit 111. In the preferred embodiment, ink supply 101 has a housing 115 (shown in phantom), and fluid outlet 113 of flexible ink reservoir 121 extends through an aperture 117 in the housing 115.

A bias means 131 biases the flexible ink reservoir 121, pressurizing the reservoir to produce a constant fluid pressure at fluid outlet 113. In one preferred embodiment, bias means 131 is a spring which will be discussed in more detail later. To operate properly, many printheads have an operating pressure range that must be maintained in a narrow specific pressure range of slightly negative gauge pressure, typically between −1 and −6 inches of water. Gauge pressure refers to a measured pressure relative to atmospheric pressure. If the pressure within the printhead falls outside this narrow specified pressure range, print quality may be reduced. In addition, the printhead 103 reliability can be reduced by printhead 103 operation at pressures other than the specified pressure range.

A pressure regulator 109 is provided to ensure that printhead 103 is maintained in this specified pressure range. The pressure regulator 109 is disposed in a fluid path between ink supply 101 and printhead 103, and controls the pressure of the ink entering printhead 103. Although pressure regulator 109 is shown in FIG. 1 to be an integral part of the printhead 103, it can be positioned at other locations between the fluid outlet 113 and printhead 103.

The pressure regulator 109 compensates for pressure variations resulting from temperature, atmospheric pressure changes, and ink supply 101 pressure variation, among others. The size of the regulator can be related to the range of pressures the regulator must compensate for. For the case where the pressure regulator 109 is of the type having an accumulator and a valve such as disclosed in U.S. patent application Ser. No. 08/549,106 now U.S. Pat. No. 5,980,028 filed Oct. 27, 1995, to Seccombe et al., the size of the pressure regulator 109 is related to the range of pressures for which the regulator is required to compensate. Therefore, for a given pressure regulator 109 design, a greater size is required to compensate for a larger range of pressure variation than a pressure regulator that compensates for a smaller range of pressure variation.

The use of the substantially constant pressure ink supply 101 of the present invention tends to reduce the size of the pressure regulator 109. Reduction of the pressure regulator 109 tends to reduce the size of the print carriage which tends to reduce the size of the printing system 100.

Printhead 103 is typically mounted in a scanning carriage (not shown). By selectively activating the printhead 103, ink is ejected from printhead 103 to form images on print media. As printhead 103 deposits ink, ink supply 101 replenishes the printhead 103 and ink is again ejected.

Printhead 103 is selectively activated by controller 105 through a communication link 107 to deposit ink on media to accomplish printing. This communication link 107 is preferably an electrical conductor, fiber optic conduit or some conventional means for transferring information between the printer controller 105 and printhead 103.

Figure 2:
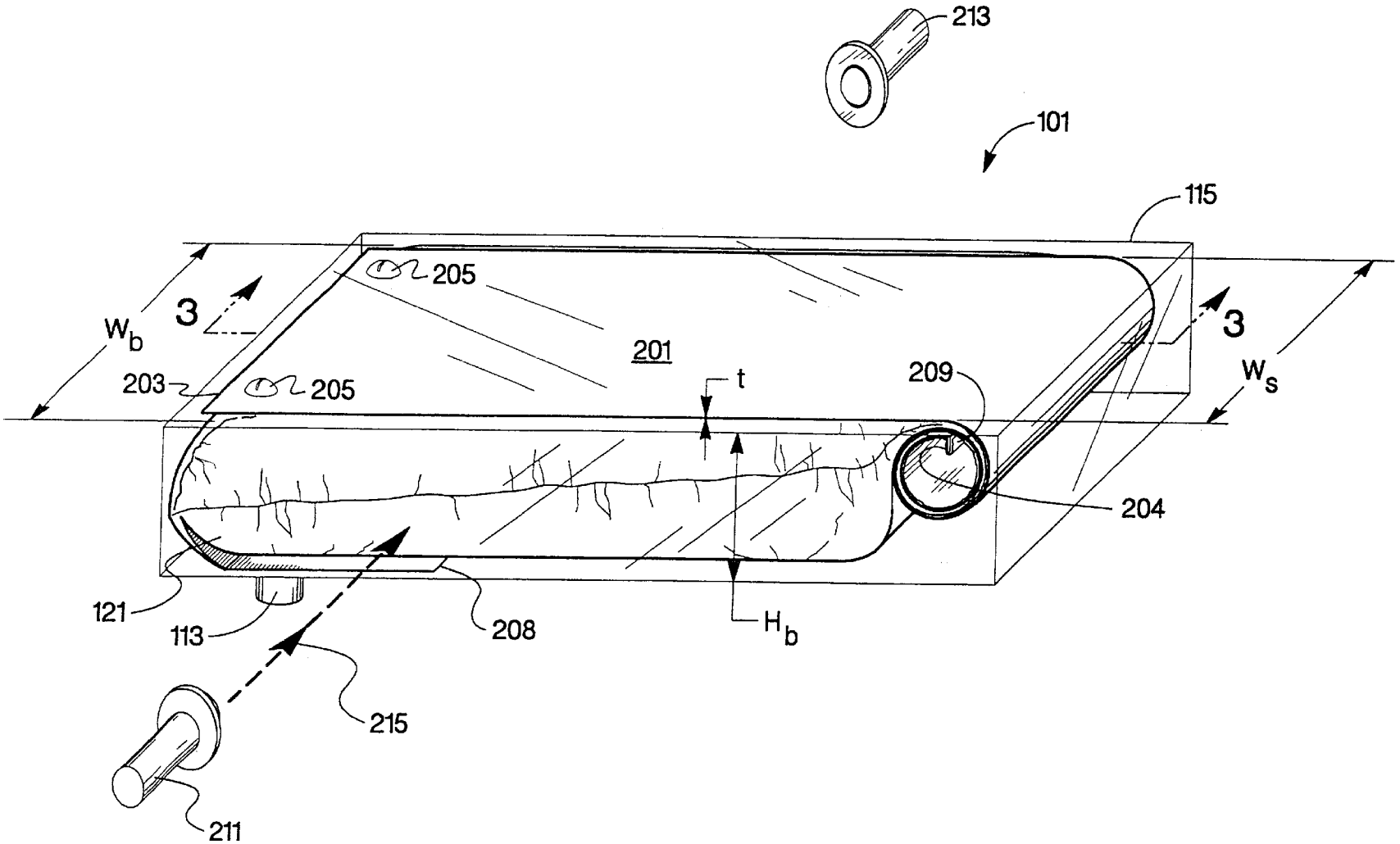
FIG. 2 depicts a perspective view of the ink supply of the present invention which includes a spring for pressurizing a flexible ink reservoir that is filled with ink.

FIG. 2 depicts the spring 201 of the present invention for applying a spring force to the flexible ink reservoir 121 for pressurizing ink within the flexible ink reservoir 121. The spring 201 is adapted to provide this spring force such that a substantially constant fluid pressure is provided at fluid outlet 113.

In a preferred embodiment, the spring 201 is a spiral spring 201 that applies a constant pressure to the flexible ink reservoir 121. In this preferred embodiment, the spring 201 is configured to have a bending moment that urges the spiral spring 201 to wind about a spring axis as the spiral spring 201 transitions from an expanded position to a contracted position. The flexible ink reservoir 121 is disposed and arranged relative to the spiral spring 201 so that as the spiral spring 201 transitions from the expanded position to the contracted position, a force is exerted on the flexible ink reservoir 121 to provide a substantially constant fluid pressure at the fluid outlet 113.

In one preferred embodiment, the spring 201 is in the expanded position and the flexible ink reservoir 121 is disposed to wind about the spring axis as the spring transitions from the expanded position to the contracted position. As the flexible ink reservoir 121 is wound about the spring axis, ink is urged from an end of the flexible ink reservoir 121 proximate the spring axis and flows toward the fluid outlet 113. As the spring 201 transitions from a compressed condition to a relaxed position, it squeezes ink out from between its coils, and ink stranding is minimized. In addition, the constant spring moment tends to produce a substantially constant fluid pressure at the fluid outlet 113.

In the preferred embodiment, housing 115 (shown in phantom) is made from a clear plastic to allow the user to see quickly the amount of ink remaining in ink supply 101. Alternatively, the housing 115 can be constructed from other materials which block light or are opaque with a window for determining remaining ink. As the ink is consumed, the flat spiral spring 201 rolls up with the flexible ink reservoir 121 and the resulting coil moves down the window toward the fluid outlet 113. To further assist the user in visually determining the remaining ink in flexible ink reservoir 121, indicia could be marked on the housing 115 that would indicate remaining ink with respect to the position of the rolled coil within the housing 115. It is preferred that housing 115 be formed from a recyclable material such as Polyethylene Terephthalate (PET), allowing easy recycling, or deposition in standard waste streams.

Flat spiral spring 201 has a trailing spring end 203 and a leading spring end 204. The leading spring end 204 is the first end to coil about the spring axis with the trailing spring end 203 last to be rolled up. The flat spiral spring 201 is fixedly attached near the trailing spring end 203 to the interior surface of housing 115 by spring fasteners 205. Spring fasteners 205 are shown in FIG. 2 as screw and nut fasteners, but it is contemplated that flat spiral spring 201 could be held in place by rivets, glue, or any other fastening means that would restrict the movement of flat spiral spring 201.

The leading spring end 204 includes a fastening feature for securing the leading spring end 204 to leading reservoir end 209 of the flexible ink reservoir 121 opposite the fluid outlet 113. In the preferred embodiment, this fastening feature is formed by bending an end of the flat spiral spring 201 back to pinch the flexible ink reservoir 121 and secure the flexible ink reservoir 121 to the leading spring end 204.

In the preferred embodiment, the flat spiral spring 201 and flexible ink reservoir 121 are attached at their leading ends. Flat spiral spring 201 and flexible ink reservoir 121 will then wind together from their leading ends toward their trailing ends. Their trailing ends are proximate to fluid outlet 113 which is fluidly coupled to fluid conduit 111.

Alternatively, the spring is attached using an adhesive that attaches the flexible ink reservoir 121 to the surface of flat spiral spring 201. This alternate method would be inexpensive and easily manufacturable.

The spring force created by the configuration of flat spiral spring 201 and the positioning of the spring 201 relative the flexible ink reservoir 121 tend to maintain a relatively constant positive pressure at fluid outlet 113. The relationship between the spring force and the construction of flat spiral spring 201 and flexible ink reservoir 121 are described in the equations that follow.

The relationship between the pressure in flexible ink reservoir 121 (referred to as a "bag" in the following equations) and the characteristics of flat spiral spring 201 (referred to as a "spring" in the following equations) and the reservoir dimensions is described by the following equations.

The force on the spring is the bag cross-sectional area (perpendicular to the spring motion) times the bag internal pressure which can be represented in equation (1) as follows:

$$F_b = A_b * P_b \tag{1}$$

Where $F_b$ represents the force acting on the bag, $A_b$ represents an area of the bag in which the force is acting, and $P_b$ represents the bag internal pressure. Assuming that the bag substantially fills the housing 115 for maximum volumetric efficiency, then the height of the bag will equal the height of the housing.

Assuming that the spring force, $F_b$, acting on the bag will be the entire cross-sectional area of the bag, then the area of the bag can be represented by the width of the bag, $W_b$, times the height of the housing, H. Substituting for the area of the bag, $A_b$, in equation (1) yields equation (2).

$$F_b = W_b * H * P_b \tag{2}$$

That force exerts a moment on the bottom of the spring of:

$$M_b = F_b * H/2 \tag{3}$$

which is countered by the spring moment, $M_s$:

$$M_s = M_b \tag{4}$$

But, $M_s$, is the moment of the spring, which was formed to a relaxed radius, $R_s$. That moment, $M_s$ is:

$$M_s = EI/R_s \tag{5}$$

where

E=modulus of elasticity

I=moment of inertia

The moment of inertia is:

$$I = t^3 W_s / 12 R_s \tag{6}$$

where $W_s$=the spring width.

Therefore:

$$M_s = E t^3 W_s / 12 R_s^2 \tag{7}$$

and, $M_s = M_b$ implies $$\begin{aligned} E t^3 W_s / 12 R_s^2 &= F_b * H/2 \\ &= W_b H P_b * H/2 \\ &= W_b H^2 P_b / 2 \end{aligned} \tag{8}$$

Solving for $P_b$:

$$P_b = E t^3 W_s / H^2 W_b 6 R_s^2 \tag{9}$$

In general, t, $W_s$, $W_b$, and H could be variable along the length of the spring, resulting in a pressure profile that can be tailored along the length. However, this invention endeavors to make the pressure constant. Therefore, in general, t, $W_s$, $W_b$, and H could be fixed constants, and not vary with length.

Thus, by this math, the pressure is fixed no matter how long the bag unlike a normal spring pressing on a piston when the pressure is inversely proportionate to the spring length.

As can be seen in the preferred embodiment of FIG. 2, the spring width, $W_s$, remains constant from trailing spring end 203 to leading spring end 204. However, in an alternate embodiment, this width could be made to vary along the length. The flexible ink reservoir 121 width, $W_b$, also remains constant from first reservoir end 208 to second reservoir end 209 as does flexible ink reservoir 121 height, $H_b$. Spring steel, in a range of 0.002–0.006 inches in thickness, is used in the preferred embodiment. However, a flat spiral spring constructed from a pre-formed plastic material, such as recyclable Polyethylene Terephthalate (PET), has also been contemplated.

Flexible ink reservoir 121 is constructed from a thin, flexible material, such as Mylar which is a form of oriented Polyethylene Terephthalate (PET). In the preferred embodiment, there is a fluid outlet 113 preferably build into flexible ink reservoir 121 to allow the ink contained within flexible ink reservoir 121 to flow out of the reservoir. FIG. 2 shows fluid outlet 113 near the trailing reservoir end 208 to a surface opposite the spring fasteners 205. However, fluid outlet 113 could also be located anywhere near the trailing reservoir end 208 that would allow for the complete rolling of flexible ink reservoir 121 ending near fluid outlet 113 in order to squeeze as much ink as possible from flexible ink reservoir 121. Fluid outlet 113 is extending through an aperture 117 (FIG. 1) in housing 115 and, in the preferred embodiment, held in place with an adhesive. An alternative fixing of fluid outlet 113 within aperture 117 has been contemplated which would heat stake the flexible ink bag 121 and fluid outlet 113 to the housing 115 around the perimeter of the aperture 117 thereby sealing the housing 115.

External to ink supply 101 is an ink level detecting system. In the preferred embodiment of the invention, this system is an electronic through beam sensor. The system includes an ink detector sending device 211 and an ink detector receiving device 213. In the preferred embodiment, this sensing system is a permanently fixed component of the printer carriage mechanism and is not replaced when ink supply cartridges are replaced. Ink detector sending device 211 and ink detector receiving device 213 are positioned to detect when the flexible ink reservoir 121 is substantially depleted of ink. In one preferred embodiment illustrated in FIGS. 2–7, flat spiral spring 201 and flexible ink reservoir 121 roll up together as ink is consumed. When the supply of ink has reached a near depletion state, flexible ink reservoir 121 no longer interrupts a light beam 215 emitted by ink detector sending device 211 that is received by ink detector receiving device 213. Once an out of ink or low ink condition is detected, the user is notified of this low ink condition.

Alternatively, the ink level sensing could be accomplished by a variety of other switches or sensing devices such as a mechanical limit switch, a proximity switch, or any such device that is capable of detecting the position of the flexible ink reservoir 121 or the spiral spring 201. These switches or sensing devices detect when the spring 201 is fully contracted or nearly fully contracted indicating that the flexible ink reservoir 121 is out of ink or nearly out of ink. For example, in the case of a mechanical limit switch, the switch is mounted to the housing 115 and is actuated if the spiral spring 201 reaches a fully contracted position where upon the mechanical switch is engaged producing an out of ink signal.

Alternatively, a more comprehensive ink level sensing scheme is used to provide a better indication of ink remaining as the flexible ink reservoir 121 transitions from a full state to an empty state. One such scheme senses the position of the flat spiral spring 201 and the flexible ink reservoir 121 as they roll between the expanded (ink full) position to the contracted (ink empty) position. This spring information is provided to the printing system 100 for determining and reporting to the user ink level status throughout the life of the ink supply 101. This sensing scheme is alternatively accomplished by an inductive, resistive, light reflective, or other technique for providing an indicative signal of a position of the flat spiral spring 201. This signal value is converted in the printing system 100 to an amount of ink remaining in the flexible ink reservoir 121.

Figure 3:
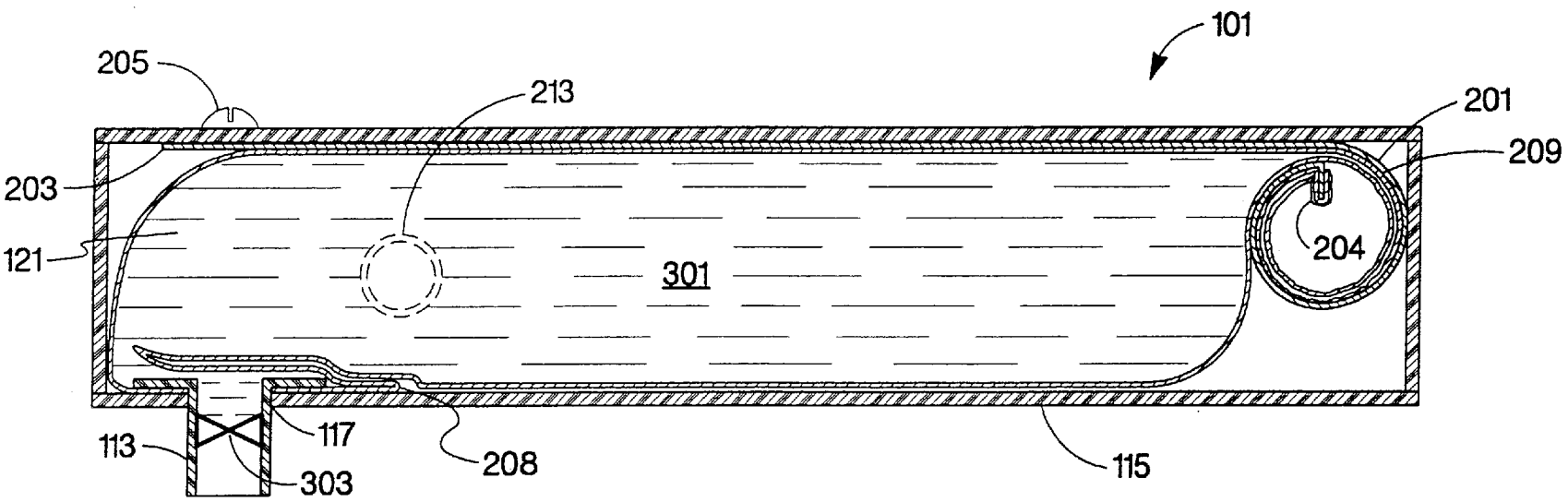
FIG. 3 depicts a cross section of the ink supply of FIG. 2 taken through line 3—3.

FIG. 3 shows a cross section of the ink supply 101 taken through line 3—3 of FIG. 2. Flexible ink reservoir 121 is shown full of ink 301 with flat spiral spring 201 in an unwound or expanded condition. The flat spiral spring 201 applies a force on the flexible ink reservoir 121 to maintain a constant pressure at the fluid outlet 113. The fluid pressure at fluid outlet 113 is substantially constant as the spring transitions from the expanded position shown in FIG. 2 and FIG. 3 to a contracted position shown in FIG. 6 and FIG. 7.

A fluid flow valve 303 is shown in a fluid path between the flexible ink reservoir 121 and the fluid outlet 113. In the preferred embodiment of the invention, fluid flow valve 303 is in a closed position preventing fluid from passing from the flexible ink reservoir 121. Once the ink container 101 is properly installed into the printing system 100, the fluid flow valve is actuated and ink 301 allowed to flow between the flexible ink reservoir 121 and fluid conduit 111 (FIG. 1). In an alternate embodiment, fluid flow valve 303 is replaced by a septum for a needle.

One method for filling flexible ink reservoir 121 with ink is to uncoil flat spiral spring 201 to its expanded position, then filing flexible ink reservoir 121 with a quantity of ink at fluid outlet 113. With the spring force removed, flexible ink reservoir 121 is inflated with ink using a minimum fluid pressure on the quantity of ink. Alternatively, with the flat spiral spring 201 in its contracted position, filling takes place by applying pressure to the quantity of ink greater than the spring force of the flat spiral spring 201 whereby the flat spiral spring 201 and the flexible ink reservoir 121 are uncoiled by the filling of the flexible ink reservoir 121. These methods are not only for filling the flexible ink reservoir 121 at the initial manufacture of the ink supply 101, but are also for refilling the flexible ink reservoir 121 after the ink reservoir 121 is depleted of initial ink.

It has also been contemplated that valve 303 is a three-position valve having an "off", a "fill", and a "dispense" setting manually selected by the user. In the "off" position, the three-position valve would restrict the flow of ink from flexible ink reservoir 121. In the "on" position, ink would freely flow out but would not allow ink or air to flow back into flexible ink reservoir 121. In the "fill" position, the three-positioned valve would allow ink to be refilled into the flexible ink reservoir 121 while not allowing it to flow out. In general, the three-position valve allows refilling of ink supply cartridge 101 while having means to control air from entering flexible ink reservoir 121, and thereby the printhead, while filling and dispensing.

Figure 4:
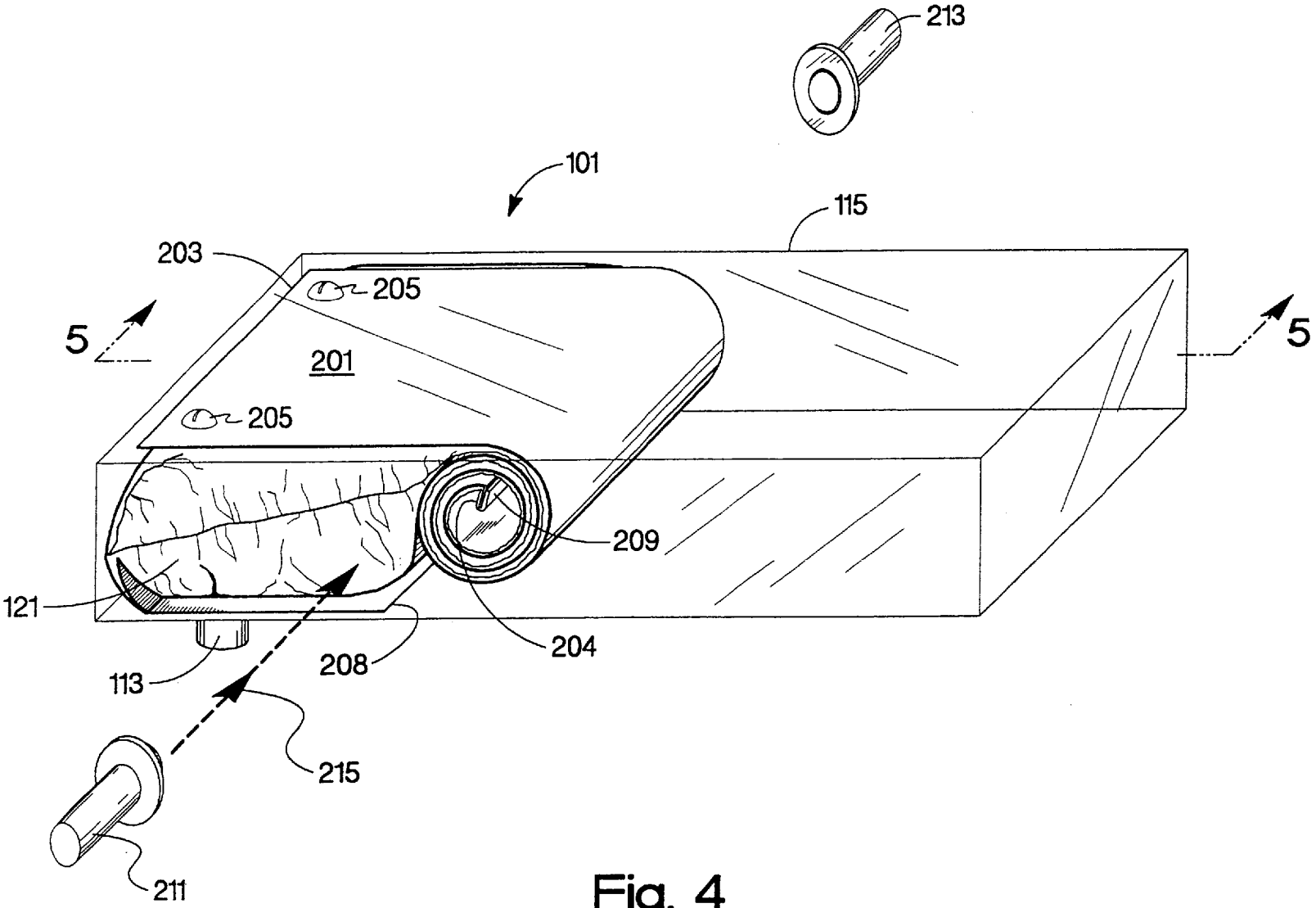
FIG. 4 depicts a perspective view of the ink supply of the present invention with the flexible ink reservoir partially depleted of ink.

FIG. 4 depicts a perspective view of the ink supply 101 with the flexible ink reservoir 121 partially depleted. As the ink 301 (FIG. 3) is being consumed, the flat spiral spring 201 is rolling itself together with the flexible ink reservoir 121 beginning from their leading ends, 204 and 209 respectively, toward the trailing spring end 203. At the stage of depletion shown in FIG. 4, the beam 215 emitted from ink detector sending device 211 is still blocked by flexible ink bag 121 and thereby not received by ink detector receiving device 213. The printing system can print the next page because there is sufficient ink in the flexible ink reservoir 121. Alternatives to this sensing system have been contemplated such as a mechanical limit switch internal to housing 115, or a single electrical proximity switch either internal or external to housing 115. Any device that can detect presence or absence of the ink reservoir 121 or flat spiral spring 201 will suffice.

Figure 5:
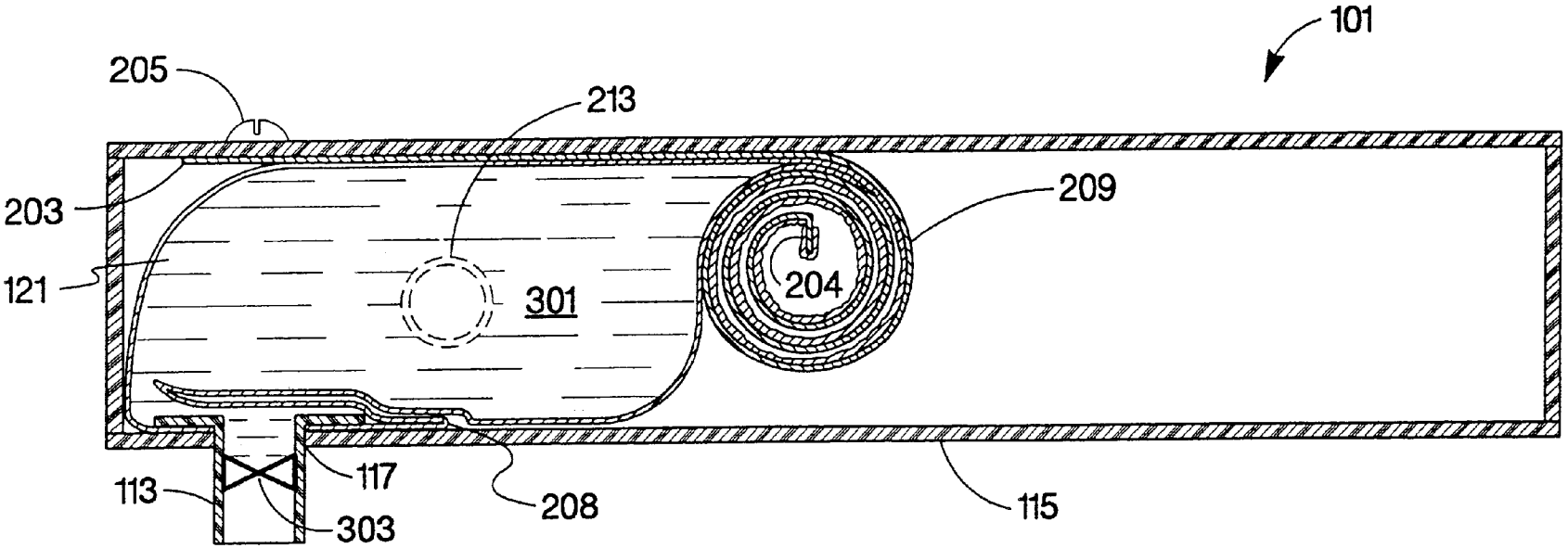
FIG. 5 depicts a cross section of the ink supply of FIG. 4 taken through line 5—5.

FIG. 5 shows a cross section of the partially depleted ink supply 101 at line 5—5 in FIG. 4. FIG. 5 illustrates the collapsing of flexible ink reservoir 121 by flat spiral spring 201 due to ink consumption. In the preferred embodiment of the invention, where there is a housing 115, it is critical that the rolled combination of flat spiral spring 201 and flexible ink reservoir 121 maintain an overall circumference throughout the use of the ink supply 101 which is less than the depth of the interior of housing 115. If the flat spiral spring does not roll tight enough and its circumference reaches the interior depth of housing 115, the roll will become lodged within housing 115. Once the spring force is no longer applied to the flexible ink reservoir 121, the fluid pressure is reduced at fluid outlet 113 thereby limiting the ink flow rate of ink to the supply of ink to the printhead 103.

Figure 6:
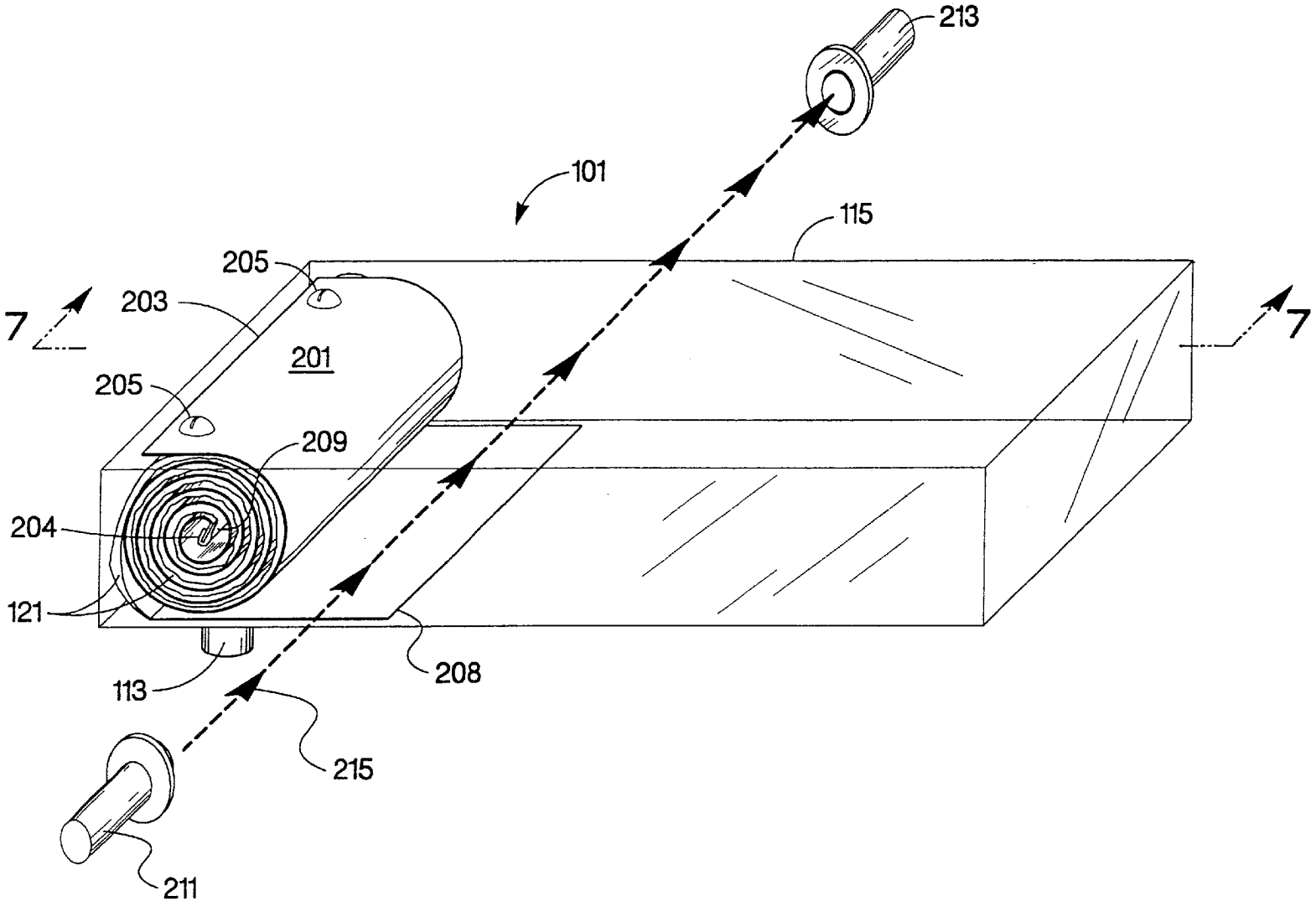
FIG. 6 depicts a perspective view of the ink supply of the present invention with the flexible ink reservoir substantially depleted of ink.

FIG. 6 depicts a perspective view of the ink supply cartridge 101 of the present invention with the flexible ink reservoir 121 near depletion. In the preferred embodiment, as soon as the combination of flat spiral spring 201 and flexible ink reservoir 121 reach the "near" depletion state, as shown in FIG. 6, the emitted light beam 215 of sensor sending device 211 is no longer blocked by flexible ink reservoir 121 and the emitted light beam 215 is then received by sensor receiving device 213. This received signal is communicated to printer controller 105 (FIG. 1) which reports the information to the user.

The placement of the sensing system, ink sensor sending device 211 and sensor receiving device 213 in the preferred embodiment, is determined by the format of the printer. For example, a large format printer or plotter places the sensors so that the user is alerted with enough ink remaining to finish the most ink consuming page possible before the ink supply 101 is required to be changed or replenished. In one embodiment, the sensing system is placed to minimize unused ink at "ink out" alarm conditions while maintaining confidence in the user that there is always enough ink remaining to complete the page that has been started. The system is designed to avoid the nuisance and resource waste of exhausting the ink supply 101 in the middle of printing a page. Moreover, allowing the printhead 103 to reach the state of complete ink exhaustion can result in operation of the printhead 103 without ink which can potentially result in catastrophic damage and failure of the printhead 103.

Figure 7:
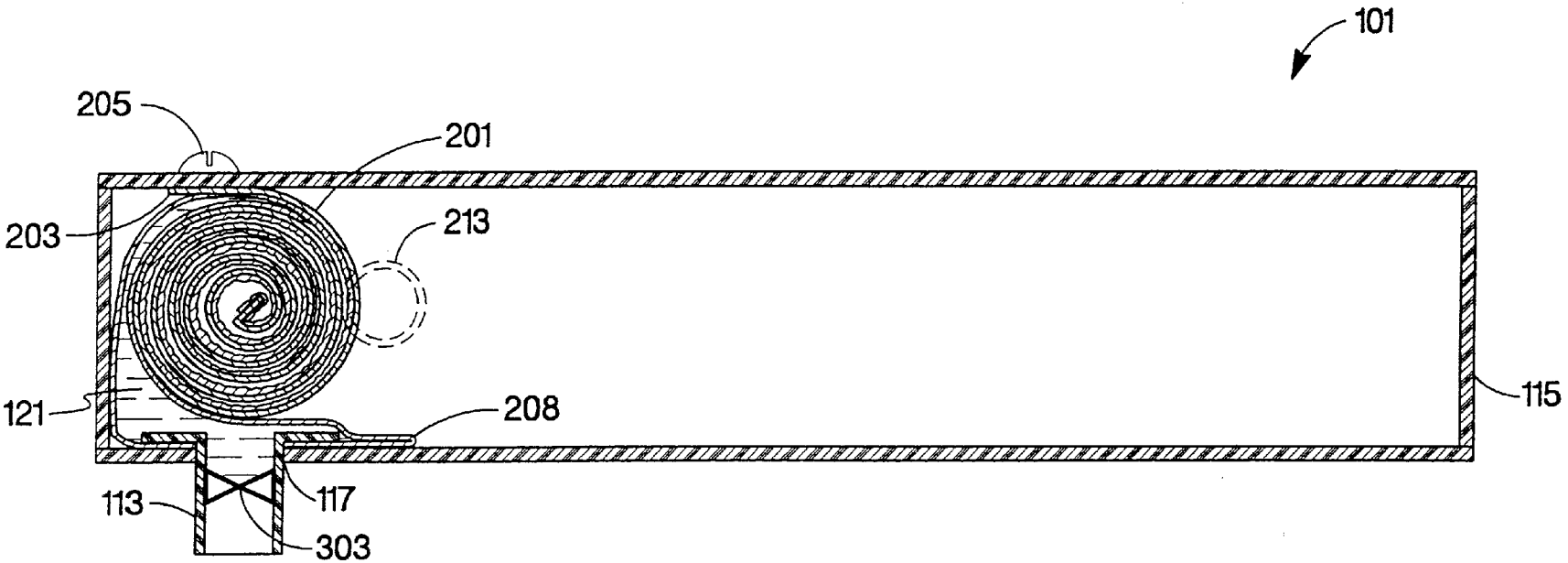
FIG. 7 depicts a cross section of the substantially depleted ink supply of FIG. 6 taken through line 7—7.

FIG. 7 shows a cross section of the ink supply 101 at line 7—7 in FIG. 6. Flat spiral spring 201 has rolled and compressed flexible ink reservoir 121 to a point past the combination of sensor sending device 211 and sensor receiving device 213 (shown in phantom) thereby allowing emitted light beam 215 (FIG. 6) to be received by sensor receiving device 213. At this time, printer controller 105 (FIG. 1) is signaled by the sensing system that ink 301 has reached a critically low level and that the user should change the ink supply 101 prior to the start of another print job or page.

FIG. 7 illustrates the flat spiral spring 201 rolled past the first reservoir end 208 that in anchored under a flanged portion of fluid outlet 113 as fluid outlet 113 is inserted and projected through aperture 117. In this preferred embodiment, flat spiral spring 201 is anchored to the interior surface of housing 115 opposite flexible ink reservoir 121 such that flat spiral spring 201 continues to coil toward its trailing spring end 203 thereby drawing the combined roll of flat spiral spring 201 and flexible ink reservoir 121 toward spring fasteners 205. As the spring 201 reaches a coiled position, ink remaining in the flexible ink reservoir 121 is minimized. To further minimize the remaining ink in the flexible ink reservoir 121, it has been contemplated to contour the interior of housing 115 to conform to the front edge of the roll made by the coil of flat spiral spring 201 at the "ink out" state, to minimize the stranding of ink in the corners of housing 115. In addition, the spring 201 when coiled is positioned so that the fluid outlet 113 is not occluded.

Figure 8:
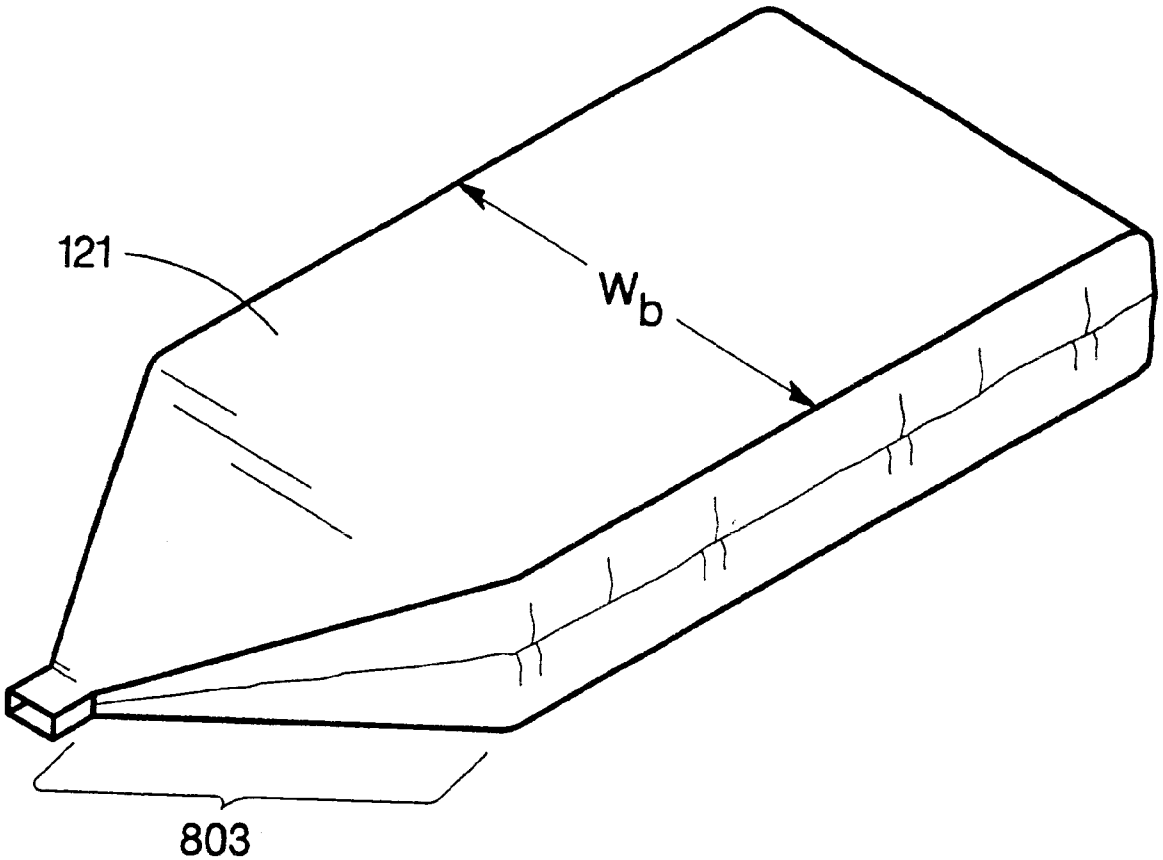
FIG. 8 depicts a perspective view of the flexible ink reservoir shown in FIG. 2.

FIG. 8 depicts a perspective view of a preferred embodiment of the flexible ink reservoir 121 shown filled with ink and without housing 115 (see FIG. 2). In this preferred embodiment the flexible ink reservoir 121 included a region 803 proximate a reservoir opening 801 that has a reduced dimension. The use of the reduced width region 803 tends to minimize stranded ink in the flexible reservoir 121. Because this reduced width region 803 is the last portion of the flexible reservoir 121 that is rolled up, any ink that is stranded in the flexible reservoir 121 will be in the reduced width region 803. By tapering or reducing the width of the flexible reservoir 121 in this region, the volume of the reservoir in the region is reduced, thereby reducing the volume of ink which could be stranded if the reservoir did not coil completely. In addition, this narrowing feature of flexible ink reservoir 121 aids in the minimization of ink stranding in flexible ink reservoir 121 by eliminating potential corners in the flexible ink reservoir 121. In FIG. 2, reduced width region 803 to bag opening 801 of flexible ink reservoir 121 is not shown because it is folded under flexible ink reservoir 121.

In FIG. 8, reduced width region 803 has been shown and described with the main purpose begin to reduce volume in the final portion of flexible ink reservoir 121. Although the reduced width region 803 has been shown in FIG. 8 as decreased in both the width, $W_b$, and the height, H, dimensions, a reduction in the flexible ink reservoir size in only one of these dimensions will also reduce the volume of stranded ink.

FIG. 8 shows a gusseted flexible ink reservoir in the preferred embodiment. Alternatively, flexible ink reservoir is a simple "peanut bag" constructed from two flat pieces of material of a shape similar to a top view of the flexible ink reservoir of FIG. 8 that also includes a reduced width region. The two pieces of material are welded or sealed around the edges with an opening at the narrowest end of the reduced width region for filling and dispensing of the ink.

Figure 9:
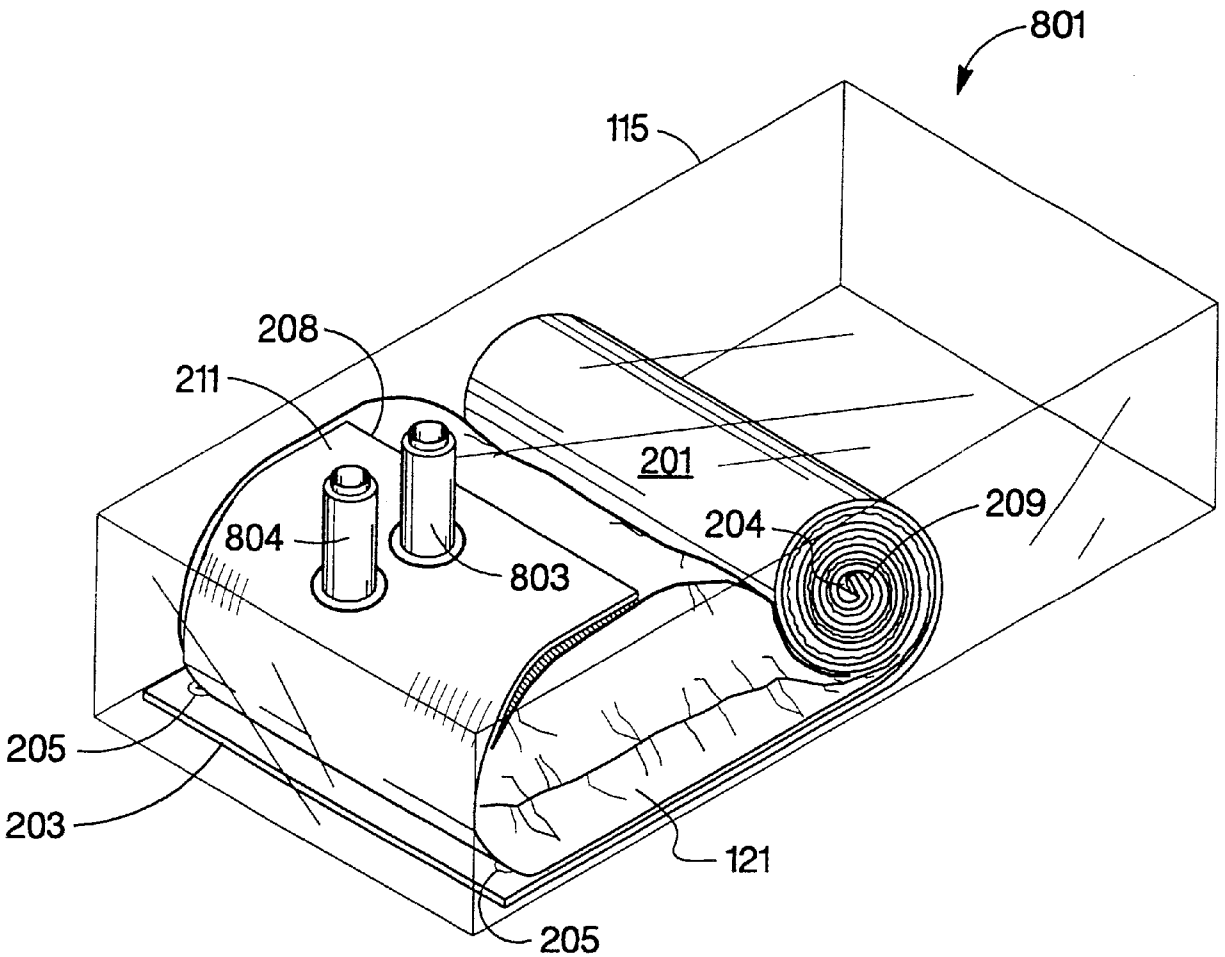
FIG. 9 depicts a perspective view of an alternate embodiment of the present invention having a fluid inlet for filling the ink reservoir and a fluid outlet for dispensing ink from the ink reservoir.

FIG. 9 depicts a perspective view of an alternate embodiment of the present invention. This embodiment is similar to the embodiment of the ink supply 101 shown in FIGS. 2–7 except that this embodiment includes both a fluid inlet 803 and a fluid outlet 804. The fluid inlet 803 is designed specifically for filling or refilling flexible ink reservoir 121. The fluid outlet 804 is designed specifically for dispensing a constant pressure ink supply to printhead 103.

There are advantages to having a fluid inlet 803 separate from the fluid outlet 804. For example, with a refillable ink cartridge, the refilling can take place at fluid inlet 803 without disturbing the printhead 103 to ink supply 101 interface at fluid outlet 804. Having two ports to the ink bag allows the design constraints for the manufacturing ink fill process to be different than the user ink removal process. Typically, one would like to fill the ink bladder quickly (less than 1 second), and then seal the fill hole permanently, whereas the other port would be designed to be smaller, lower flow rates, and re-usable.

Figure 10:
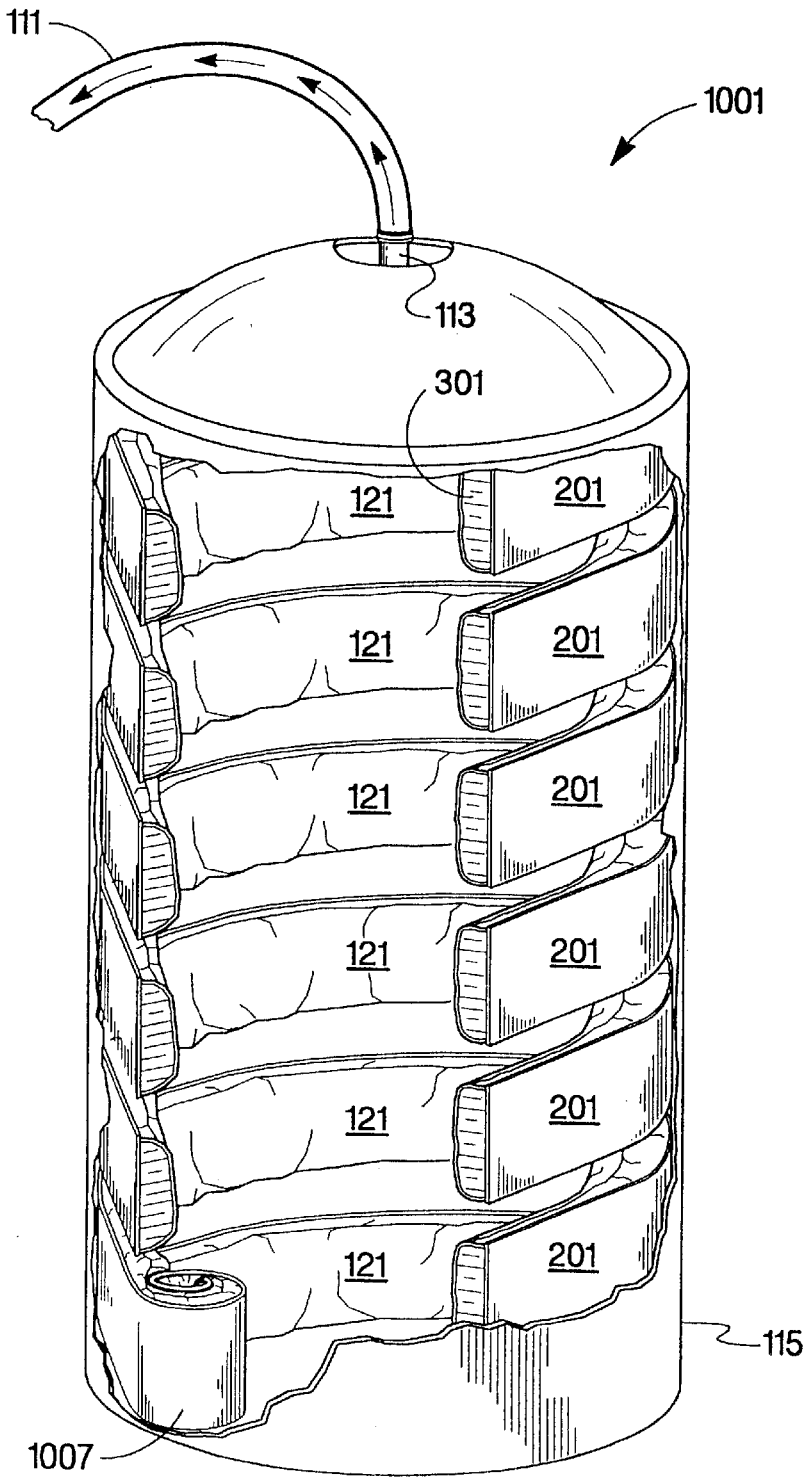
FIG. 10 depicts an alternate embodiment of the ink reservoir of the present invention which includes a flexible ink reservoir that is interleaved with a flat spiral spring that is configured to coil along a helical path.

FIG. 10 depicts an alternate embodiment of the present invention that is similar to the embodiment shown in FIGS. 2–7 except that the spiral spring 201 is extended in a helical fashion instead of a linear fashion. In this embodiment, housing 115 is cylindrically shaped and the flexible fluid reservoir 121 rolls up together with the spiral spring 201 in a helical path. For visual clarity, the spiral spring 201 is shown with a gap between wraps. The force tends to wind the spiral spring 201 along a helical path from the rolling end 1007 to a contracted position adjacent to fluid outlet 113. Also in FIG. 10, for illustrative purposes, the flexible fluid reservoir 121 is shown much thinner than would be optimum to utilize the full volume of the fluid container 1001. With fluid container 1001 full, there is minimum empty space within the container.

Fluid outlet 113 is shown emerging from the top of fluid container 1001 and coupled to fluid conduit 111. An alternate embodiment has been contemplated where fluid outlet 113 is connected to a spray nozzle whereby the spring force pressurized fluid container 1001 would be a viable replacement for aerosol fluid dispensers.

The present invention is a low cost pressurization method for supplying constant pressure ink to a printhead. With the disposable components being simplistic and minimal in number, the cost of manufacturing is substantially reduced over the current products.

Finally, the present invention is applicable to many applications that require a pressurized fluid source without a need for pumps or chlorol fluro carbon propellants. Although the preferred embodiment of the present invention is a relatively low pressure application, higher pressure applications could be accommodated by altering the architecture of the flexible spring and/or the shape and size of the fluid reservoir according to the aforementioned equations (1)–(9).

Although the preferred embodiments of the present invention disclose that the flexible fluid reservoir is compressed between the spring to dispense fluid from the flexible fluid reservoir, there are other arrangements of the spring and flexible fluid reservoir that are also within the scope of this invention. For example, the spiral spring could be applying pressure to a mechanism as it rolls up, such as a plate that is perpendicular to the direction that the spring rolls. The spring force against the plate compresses the flexible fluid reservoir thereby applying a constant pressure to the contents of the flexible fluid reservoir.

What is claimed is:

1. An ink supply for providing ink to a printing system, the ink supply comprising:

a flexible fluid reservoir for containing a quantity of fluid;

a flat spiral spring having an expanded position, and a contracted position;

a housing including an interior surface and an aperture, the flexible fluid reservoir and the spring being layered and disposed within the housing; and a pressure regulator that is in fluid communication with both a printhead and the flexible fluid reservoir;

wherein the spring is configured to operatively engage the flexible fluid reservoir as the spring transitions from the expanded position to the contracted position;

wherein the flexible fluid reservoir is biased by the spring as the spring contracts to produce fluid at a substantially constant fluid pressure at a fluid outlet; and wherein the pressure regulator is configured to receive ink at a positive pressure from the fluid outlet and provide ink at a negative pressure to the printhead.

2. The ink supply of claim 1, wherein the flat spiral spring and the flexible fluid reservoir roll together about a spring axis whereby the flexible fluid reservoir is squeezed by the roll created by the flat spiral spring and the flexible fluid reservoir thereby urging the quantity of fluid within the flexible fluid reservoir toward the fluid outlet.

3. The ink supply of claim 2, wherein the flat spiral spring and the flexible fluid reservoir are attached together with an adhesive prior to rolling together about the spring axis.

4. The ink supply of claim 1, wherein the spring is spring steel.

5. The ink supply of claim 1, wherein the spring is pre-formed plastic.

6. The ink supply of claim 1, wherein the housing is cylindrical shaped having a container top and a container bottom wherein the flexible fluid reservoir and the spring roll together in a helical path originating from the container bottom toward the container top.

7. The ink supply of claim 1, further comprising an ink level sensor positioned such that when the reservoir is nearly depleted, the sensor is activated.

8. The ink supply of claim 7, wherein the ink level sensor is a mechanical limit switch.

9. The ink supply of claim 7, wherein the ink level sensor is a through beam sensor having a sending device and a receiving device for determining remaining ink within the ink supply.

10. The ink supply of claim 7, wherein the ink level sensor is an electrical proximity switch.

11. The ink supply of claim 1, further including a fluid level sensing device for determining a remaining fluid level in the flexible fluid reservoir.

12. The ink supply of claim 11, wherein the fluid level sensing device is a position sensing device for detecting the position of one of the spring or the flexible fluid reservoir as it moves between the expanded position and the contracted position of the spring.

13. The ink supply of claim 1, wherein the flexible fluid reservoir is fixedly attached to the interior surface of the housing proximate the aperture.

14. The ink supply of claim 1, wherein the spring is fixedly attached to the interior surface of the housing so as to avoid interference with outflow of fluid from the fluid outlet of the flexible fluid reservoir.

15. The ink supply of claim 1, wherein the housing is rectangular shaped.

16. The method of claim 1, wherein after the flexible ink reservoir is depleted of a quantity of ink, further including filling the flexible ink reservoir with a supply of refill ink.

* * * * *